US011358824B2

(12) United States Patent
Lawrence et al.

(10) Patent No.: US 11,358,824 B2
(45) Date of Patent: Jun. 14, 2022

(54) HIGH THROUGHPUT DOUBLE STAPLE SYSTEM AND METHOD

(71) Applicant: Toshiba TEC Kabushiki Kaisha, Shinagawa-ku (JP)

(72) Inventors: Michael W. Lawrence, Lexington, KY (US); Zineeddine Hamoudi, Lexington, KY (US)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 163 days.

(21) Appl. No.: 16/804,838

(22) Filed: Feb. 28, 2020

(65) Prior Publication Data

US 2021/0269271 A1 Sep. 2, 2021

(51) Int. Cl.
*B65H 37/04* (2006.01)
*B65H 43/06* (2006.01)

(52) U.S. Cl.
CPC ..... *B65H 37/04* (2013.01); *B65H 43/06* (2013.01); *B65H 2301/152* (2013.01); *B65H 2301/361* (2013.01); *B65H 2301/363* (2013.01); *B65H 2408/121* (2013.01); *B65H 2801/27* (2013.01)

(58) Field of Classification Search
None
See application file for complete search history.

(56) References Cited

U.S. PATENT DOCUMENTS 5,957,652 A * 9/1999 Mimura ..... B65H 31/32 414/790.4
5,997,239 A * 12/1999 Mimura ..... B65H 31/3081 270/58.11
6,357,736 B1 * 3/2002 Kubota ..... B65H 31/3081 270/58.08
6,991,421 B2 * 1/2006 Namba ..... B42C 1/12 270/52.25
7,758,034 B1 * 7/2010 Namba ..... B65H 31/3009 270/58.07
7,874,551 B2 * 1/2011 Iguchi ..... B65H 31/3081 270/58.11
9,394,136 B2 * 7/2016 Kubo ..... B65H 31/02

* cited by examiner

*Primary Examiner* — Leslie A Nicholson, III
(74) *Attorney, Agent, or Firm* — Ulmer & Berne LLP

(57) ABSTRACT

A finisher assembly of a multifunction peripheral includes a vertically oriented stapler and a paper transport motor. When the paper transport motor rotates in the forward direction, printed pages from the print engine of the multifunction peripheral are received via a paper chute and a feed assist roller urges the printed pages into a vertical paper accumulation cache basin. Rotation of the paper transport motor also opens a biasing plate allowing the pages to freely enter the cache basin. Once all of the pages of the print job are in the cache basin, the paper transport motor rotates in the reverse direction causing the biasing plate to bias the printed pages, in the cache basin, against a registration surface of the vertically oriented stapler unit. The pages of the print job are stapled together the stapled print job is moved to the paper tray for collection by a user.

20 Claims, 5 Drawing Sheets

HIGH THROUGHPUT DOUBLE STAPLE SYSTEM AND METHOD

TECHNICAL FIELD

The subject application generally relates to printer stapler units, and more specifically to a system and method for increasing throughput of double stapled print jobs.

BACKGROUND

Document processing devices include printers, copiers, scanners and e-mail gateways. More recently, devices employing two or more of these functions are found in office environments. These devices are referred to as multifunction peripherals (MFPs) or multifunction devices (MFDs). As used herein, MFP means any of the forgoing.

MFPs may be fitted with document finishers which provide functions such as collating, hole punching or stapling. A finisher may be integrated into an MFP, or may be offered as an accessory to be fitted onto an MFP. Finisher assemblies for MFPs can include a stapler unit for stapling together a stack of printed pages associated with a print job. Print jobs can be double stapled which improves the strength of the binding over a single staple. Double stapling is typically accomplished by a single stapler unit that performs two staple operations sequentially.

BRIEF DESCRIPTION OF THE DRAWINGS

Various embodiments will become better understood with regard to the following description, appended claims and accompanying drawings wherein:

DETAILED DESCRIPTION

Figure 1:
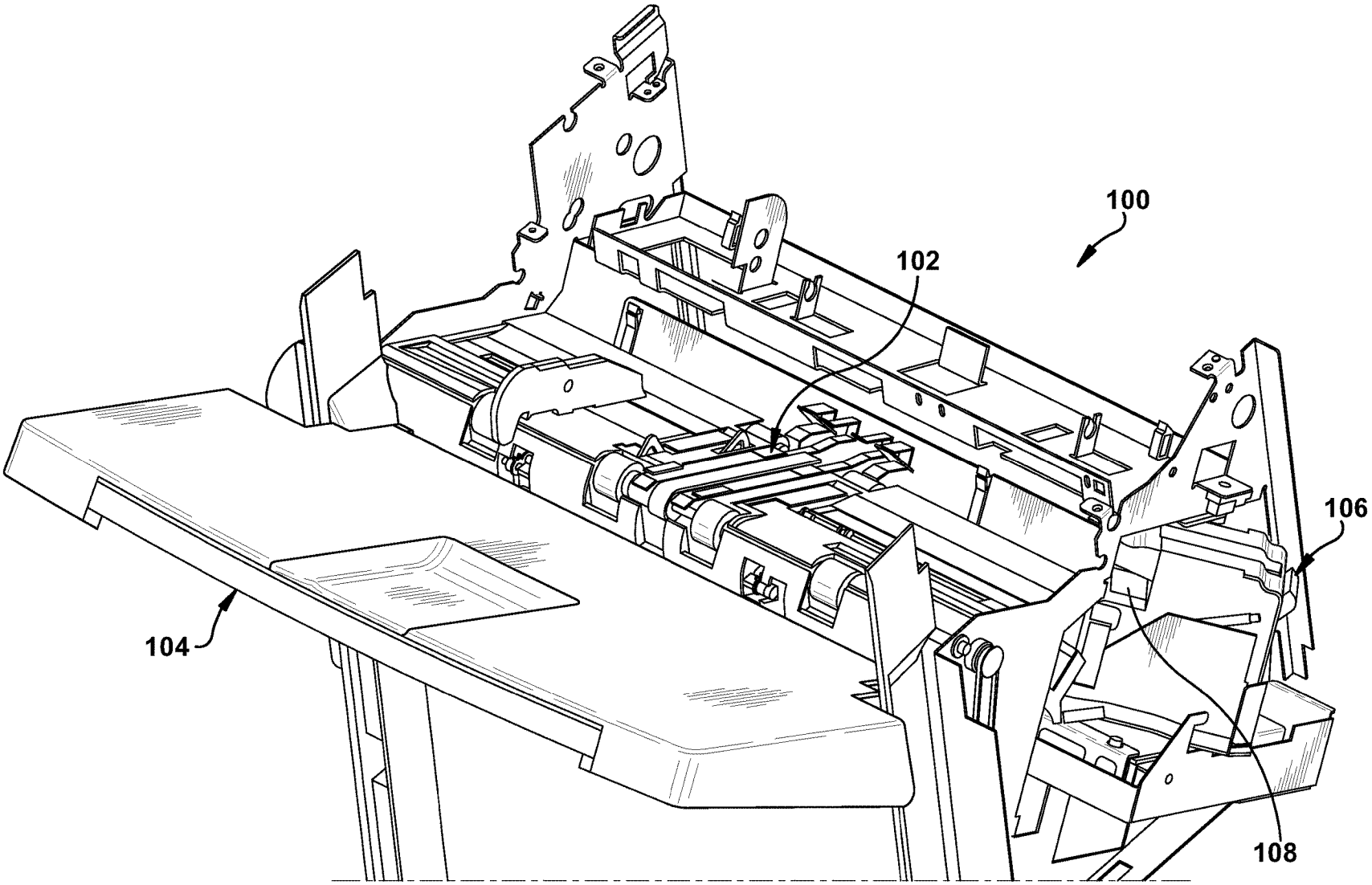
FIG. 1 is a perspective view of a finisher assembly of a multifunction peripheral that includes a stapler unit.

The systems and methods disclosed herein are described in detail by way of examples and with reference to the figures. It will be appreciated that modifications to disclosed and described examples, arrangements, configurations, components, elements, apparatuses, devices methods, systems, etc. can suitably be made and may be desired for a specific application. In this disclosure, any identification of specific techniques, arrangements, etc. are either related to a specific example presented or are merely a general description of such a technique, arrangement, etc. Identifications of specific details or examples are not intended to be, and should not be, construed as mandatory or limiting unless specifically designated as such.

A finisher assembly can use a single stapler to double staple a stack of pages of a print job. The stapler performs two staple operations sequentially, moving the printed pages slightly after the first stapling operation so that the two resultant staples are adjacent to one other but not overlapping each other.

In earlier stapling operations, timing between the first stapling operation and the second stapling operation is substantially constant. A delay time between the first stapling operation and the second stapling operation is selected based on a worst case condition for stapled pages to move from the first stapling position to the second stapling position and, optionally, taking into consideration wind-up action in the gear tray of the stapler unit itself. A worst case constant delay time ensures that the print job is always in the correct position for the second staple.

However, when a print job includes only a small number of sheets that need to be stapled together, the stapler can begin the stapling operation earlier that when the print job includes a larger number of sheets. This difference is due to the fact that with print jobs with less pages, the stapler head does not contact a top of the stack of pages as soon as it does for a print job having a large number of pages. Instead, for smaller print job, the stapler head first travels through empty air until it finally contacts the top of the stack of pages to be stapled.

In example embodiments, the high throughput double staple system and method advantageously commences the second stapling operation earlier when there are fewer pages in a print job than when there are more pages. This can substantially increase the overall throughput of print jobs processed by an MFP in two ways. First, for print jobs with fewer pages, the second stapling operation is completed earlier than it otherwise would be if a constant delay time was used. Second, for print jobs having only a few pages, the time that it takes to perform the first staple operation, move the stack or stapler, and then perform a second staple operation can be a substantial portion, or even a majority, of an entire cycle time needed to both print and double staple each individual print job. This is especially true for print jobs having multiple two page stacks that need to be double stapled, as high throughput is especially difficult to maintain in this situation. By shortening the delay, and advancing the time when the stapler begins the second staple operation, a higher number print jobs can be achieved in shorter time frame. Therefore, the high throughput double staple system can substantially increase the overall throughput of a multifunction peripheral that is tasked with printing multiple consecutive print jobs, especially when printing multiple small print jobs in a row.

With reference to FIG. 1, an example finisher assembly 100 of a multifunction peripheral having a horizontally oriented stapler unit 106 is illustrated. The finisher assembly 100 includes a finisher process tray 102, a paper tray 104 or paper accumulation tray, and a horizontally oriented stapler unit 106. The finisher process tray 102 accumulates a stack of printed pages and positions the stack against the registration surface 108 of the stapler unit 106, where a first staple operation is commenced. In order to double staple the stack of pages, the finisher process tray 102 moves the stack slightly and stapler unit 106 performs a second staple operation. Once the stack of pages is stapled in accordance to user selected finishing operations, the finisher process tray 102 moves the stack to the paper tray 104 where the user can retrieve their stapled print job.

Figure 2B:
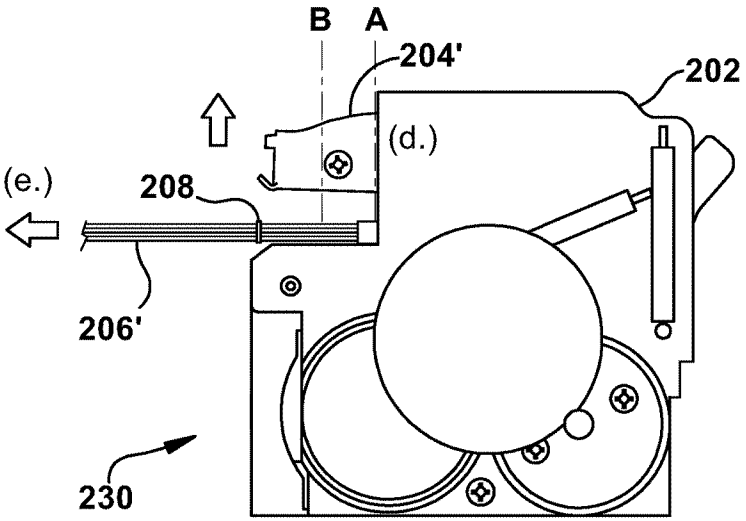
FIG. 2B is a diagram of a second operation of a prior art double staple system.
Figure 2A:
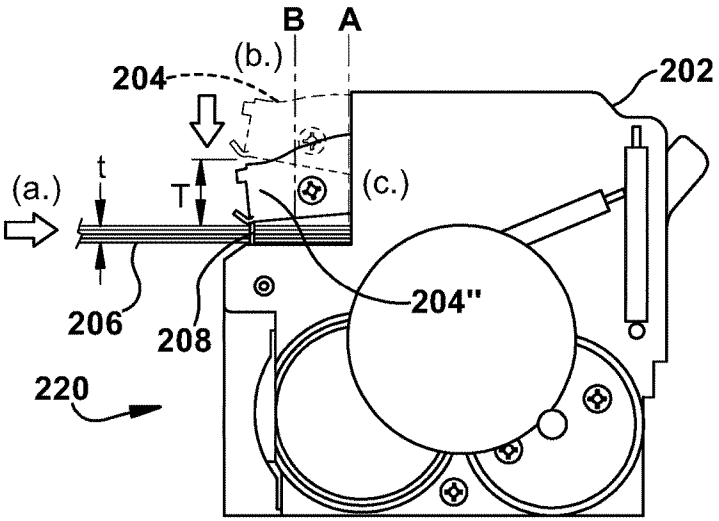
FIG. 2A is a diagram of a first operation of a prior art double staple system.

With reference to FIGS. 2A-2D, process operations for an earlier staple system 200 are illustrated. With reference to FIG. 2A, a diagram of the first operation 220 of an earlier double staple operation is illustrated. In a first operation 220, at step (a.), the stack 206 of pages of a print job to be double stapled is first moved to position A of a stapler 202. The stapler head 204 moves a distance "T" as shown from the top resting position at step (b.) to where the stapler head 204" contacts the stack 206 and inserts a first staple 208 through the stack 206 at step (c.) Distance "T" depends upon a thickness "t" of the stack 206, which depends upon a number of pages in the print job and the thickness of the particular stock of paper that is being stapled together.

In the second operation 230, illustrated in FIG. 2B, the staple head 204' begins to retract at step (d.) and the stack 206' begins to move from position A to position B at step (f).

Figure 2D:
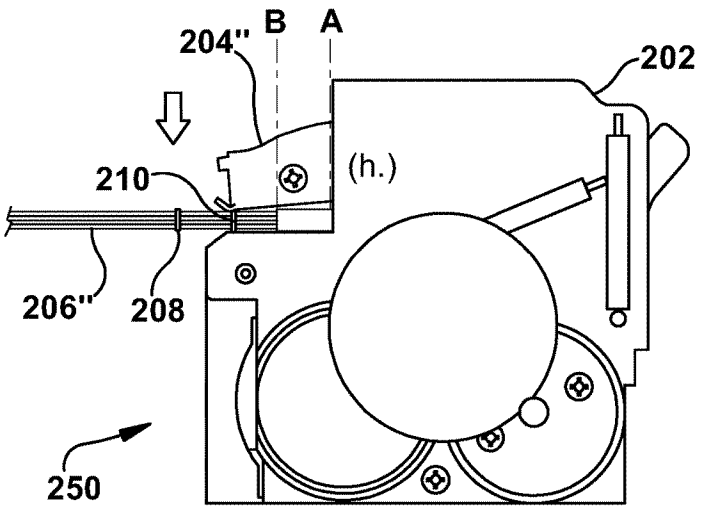
FIG. 2D is a diagram of a fourth operation of a prior art double staple system.
Figure 2C:
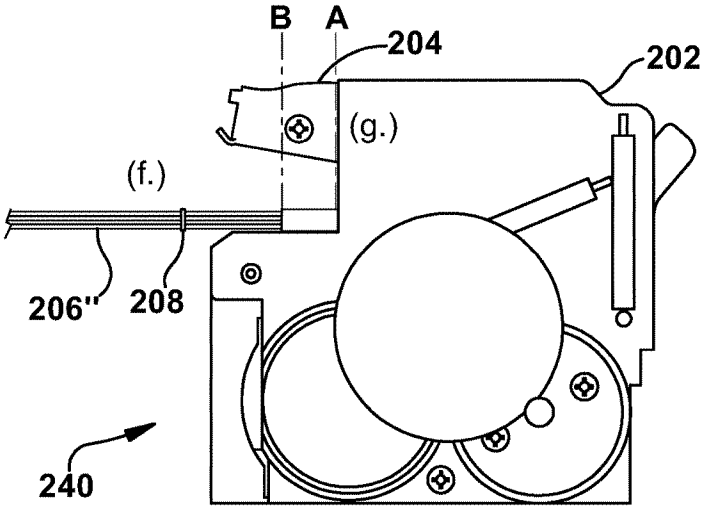
FIG. 2C is a diagram of a third operation of a prior art double staple system.

In the third operation 240, illustrated in FIG. 2C, the stack 206" has completed moving to position B at step (f.) in preparation for receiving the next staple, and the staple head 204 is back at the top resting position at step (g.)

In the fourth operation 250, illustrated in FIG. 2D, the staple head 204" contacts the stack 206" which is at position B and inserts the second staple 210 through the stack 206" to complete the double staple operation at step (h.)

Figure 3B:
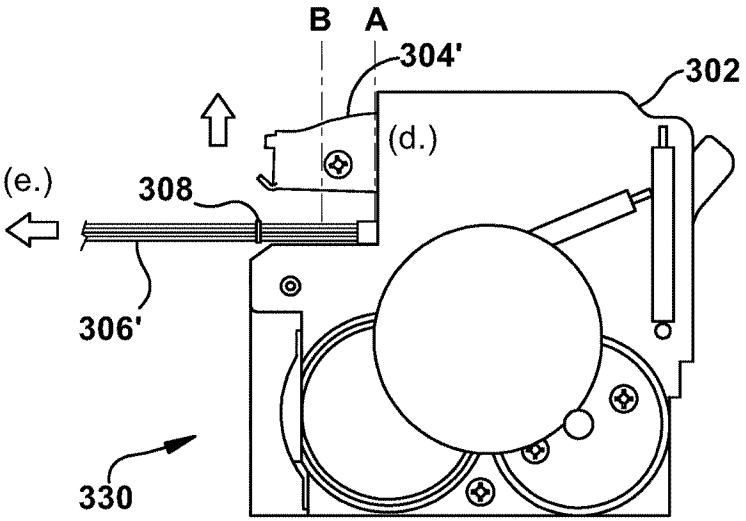
FIG. 3B is a diagram of a second operation of a high speed double staple system.
Figure 3A:
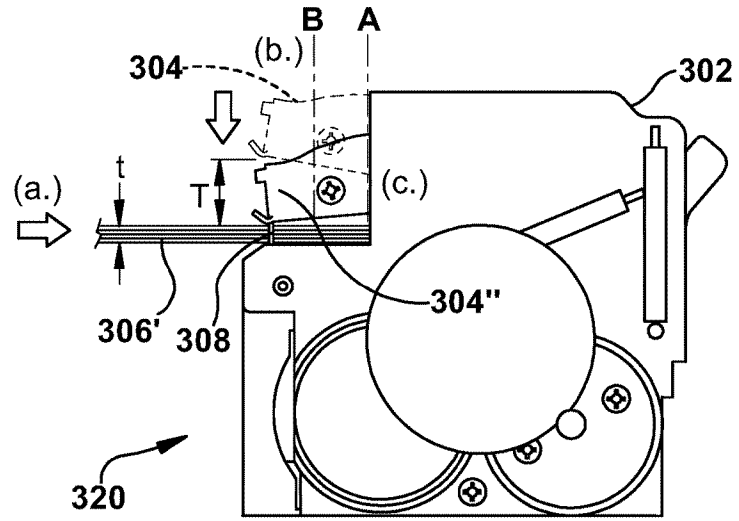
FIG. 3A is a diagram of a first operation of a high speed double staple system.

With reference to FIGS. 3A-3D, process operations for a high speed staple system 300 are illustrated. With reference to FIG. 3A, a diagram of the first operation 320 of a prior art double staple operation is illustrated. In a first operation 320, at step (a.) a stack 306 of pages of a print job to be double stapled is first moved to position A of a stapler 302. Stapler head 304 moves from a top resting position at step (b.) to step (c.) where the stapler head 304" contacts the stack 306 and inserts a first staple 308 through the stack 306.

In a second operation 330, illustrated in FIG. 3B, the staple head 304' begins to retract at step (d.) and the stack 306' begins to move from position A to position B at step (f).

Figure 3D:
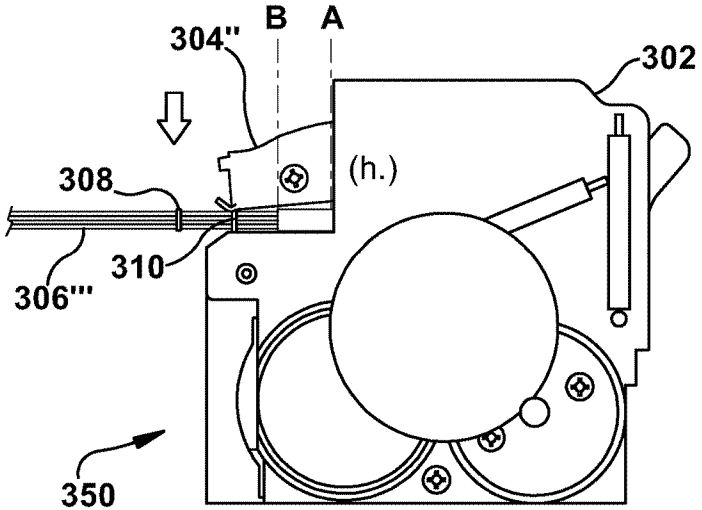
FIG. 3D is a diagram of a fourth operation of a high speed double staple system.
Figure 3C:
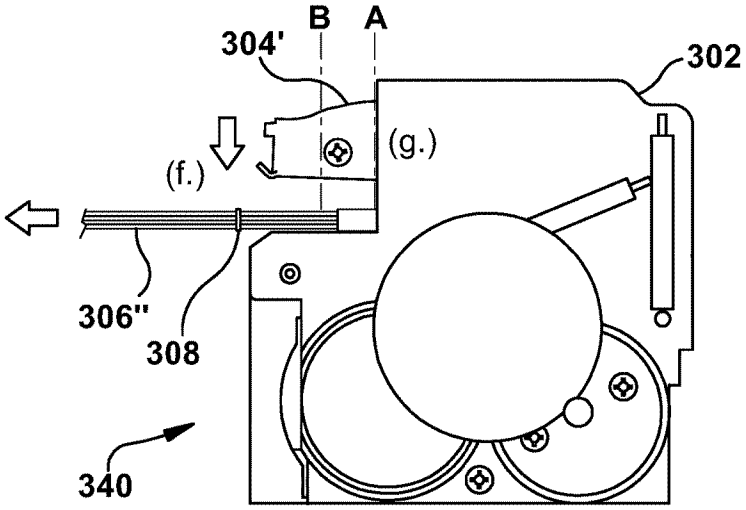
FIG. 3C is a diagram of a third operation of a high speed double staple system.

In a third operation 340, illustrated in FIG. 3C, as the stack 306" continues to move from position A to position B at step (f) the staple head 304' begins to initiate the second staple operation at step (g.) As described below in greater detail with regard to FIG. 4, the determination of when the second staple operation is commenced depends upon several factors, including the wind-up time of gearing associated with the stapler 302, the number of pages in the print job to be stapled, and the thickness of the paper stock being used for the print job.

In the fourth operation 350, illustrated in FIG. 3D, the staple head 304" contacts the stack 306"', which is now at position B, and inserts the second staple 310 through the stack 306"' at step (h.) to complete the double staple operation.

Figure 4:
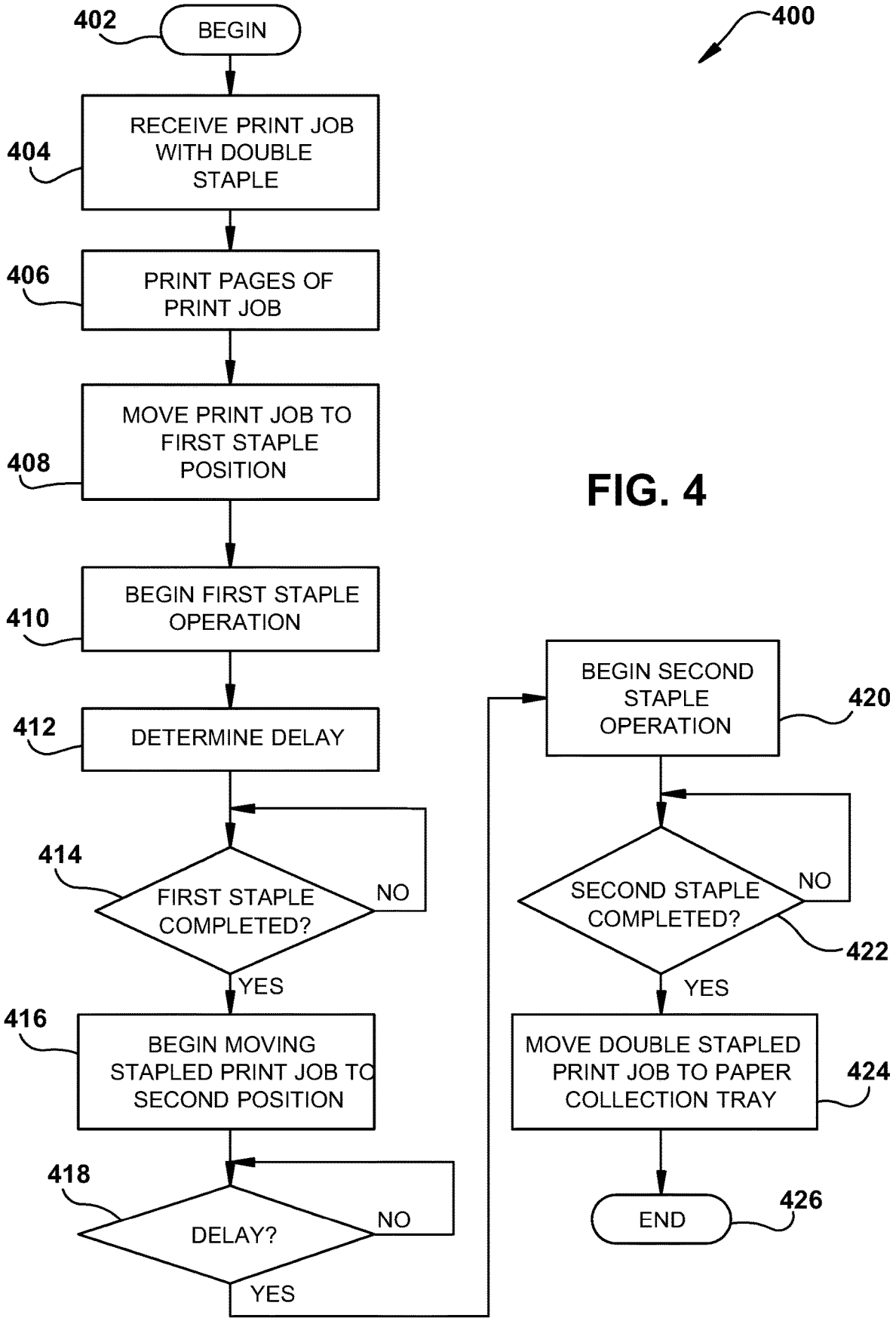
FIG. 4 is a flowchart of operations of an embodiment of a high throughput double staple finisher.

With regard to FIG. 4, a flowchart of example operations 400 of an embodiment of a high throughput double staple finisher is illustrated. Operation starts at block 402 and proceeds to block 504 where a print job that includes the double stapling finishing option is received by an MFP or other printer. Processing continues to block 406 where a print engine of the MFP prints the pages of print job and accumulates them into a stack to be stapled. At block 408, the finisher moves the stack into position to receive the first staple. For example, the finisher can move the stack into the default position used for stapling a single staple into the stack. At block 410, the stapler begins the first staple operation, for example once the stack is in proper position against the registration surface of the stapler.

At block 412, the system determines a delay before the second staple operation is commenced. Although block 412 is illustrated after block 410, the determination of the delay can be performed at any suitable time during the print operation as would be understood in the art.

For example, in various embodiments appropriate delays for a particular finisher model can be determined and a lookup table can be implemented to facilitate a rapid real-time determination of the particular delay for the current print job using a controller or suitable hardware or software as would be understood in the art. For example, the finisher can be preset to insert the second staple at a fixed distance of 125 mm from the first staple. The delay can be selected based on one or more threshold numbers of pages, such as initiating the second staple operation at 190 ms for print jobs of up to 10 pages, 200 ms when then print job is up to 30 pages, and 210 ms for print jobs up to 65 pages. For print jobs greater than 65 pages, the default maximum time can be used. By way of example, an example finisher can be the Saddle Stitch Finisher Model No. MJ-6105 available from Toshiba TEC, which is capable of performing functions such as collating, stapling, hole punching or saddle stitching in addition to double stapling.

In various other embodiments, the delay can be determined based on a number of factors, including but not limited to a wind-up time of gearing associated with the stapler itself, a number of pages in the print job to be stapled, thickness of the paper stock being used for the print job, and a distance the stack is to be moved from an initial position to a position for inserting the second staple. In yet other embodiments, the delay can be determined in real time based upon feedback from the stapler during the first stapling operation. For example, based on feedback sensors associated with the stapler, the system determines the time that the stapler head first contacts the stack of paper during the first staple operation after the first stapler operation has initiated, and uses that time as a factor to determine when to initiate the second staple operation. Advantageously, this adaptive approach can accommodate delays for situations when the thickness of the paper is not known by the system ahead of time, or when more than one kind of paper stock is used during printing, such as when printing a book that uses a thicker cover sheet.

In the embodiments detailed above, a suitable delay can be selected so that each stack of paper to be stapled has sufficient time to move into the proper position prior to the second staple operation. An appropriate delay can be selected so that the second staple can be reliably inserted into the stack adjacent to the first staple for each print job. Depending upon the selected delay, the mechanics of the stapler itself, and the number of pages in the particular stack to be stapled, the staple head may be approaching the stack at the same time that the stack is still moving into position. For example, in situations where only two or possibly several pages are being stapled together, the stapler head may be moving towards the stack before the stack has finished moving into position to receive the second staple. For larger stacks of paper, the stack may already in position to receive the second staple and therefore stationary before the stapler head begins to move towards the stack.

Once the delay for the current print job has been determined, processing continues to block 414 where the system waits for the completion of the first staple operation before continuing to block 416. Once the first staple operation has finished, the system begins to move the stack into the second position for receiving the second staple. For example, the stack can be moved such that the second staple will be inserted approximately 125 mm away from the first staple. Processing continues to block 418 where the system waits for the delay determined to in block 412 to expire. The delay is calculated from the start of the first staple operation until the start of the second staple operation. However, in practice any suitable point in time can be used for calculating the delay if practical, for example the completion of the first staple operation or when motors are activated for moving the stack towards the second position.

Once the delay has expired at block 418, the second staple operation is initiated at block 420. As detailed above, depending on the number of pages of the print job to be stapled, the second staple operation may commence while the stack of paper is still moving into proper position to receive the second staple. Once the second staple operation has completed at block 422, the double stapled print job is moved to the paper collection tray for retrieval by a user at block 424 and processing terminates at block 426.

Figure 5:
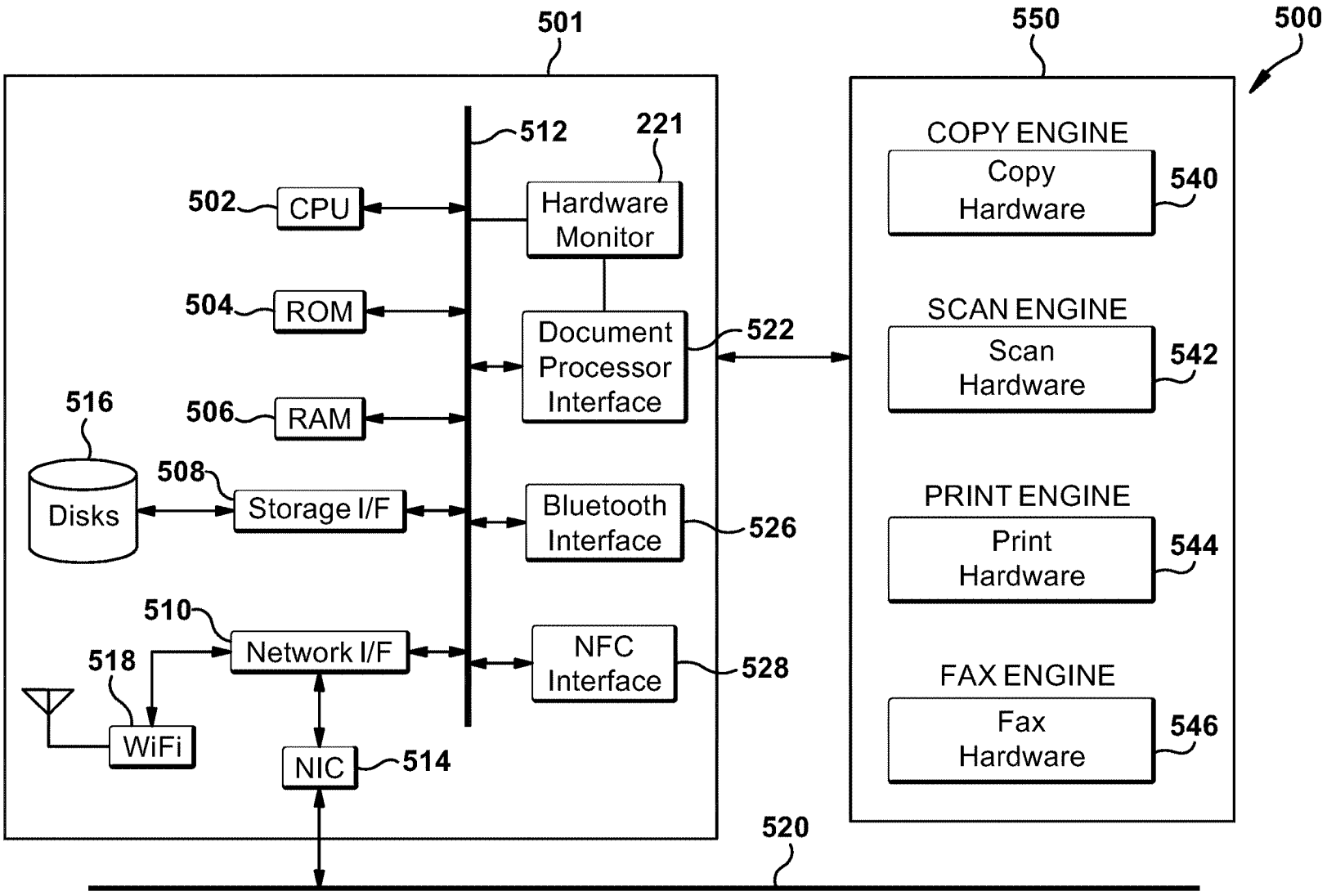
FIG. 5 is a functional block diagram of a multifunction peripheral.

In conventional MFP document processing operations, such as copying, printing, stapling or hole punching, are accomplished under software control. MFPs include an intelligent controller to manage and control device operation. FIG. 5 is a functional block diagram of an MFP 500. It is to be appreciated that a controller is itself a computer system. Included is controller 501 are one or more processors, such as that illustrated by processor 502. Each processor is suitably associated with non-volatile memory, such as read only memory (ROM) 504, and random access memory (RAM) 506, via a data bus 512.

Processor 502 is also in data communication with a storage interface 508 for reading or writing data with storage 516, suitably comprised of a hard disk, optical disk, solid-state disk, cloud-based storage, or any other suitable data storage as will be appreciated by one of ordinary skill in the art.

Processor 502 is also in data communication with a network interface 510 which provides an interface to a network interface controller (NIC) 214, which in turn provides a data path to any suitable wired or physical network connection 220, or to a wireless data connection via a wireless network interface, such as WiFi 218. Example wireless connections include cellular, Wi-Fi, wireless universal serial bus (wireless USB), satellite, and the like. Example wired interfaces include Ethernet, USB, IEEE 1394 (FireWire), Lightning, telephone line, or the like. Processor 502 is also in data communication with a hardware monitor 521, suitably amassing state data from subassemblies, sensors, digital thermometers, or the like, and suitably including digital state date including device codes, such as device error codes. Processor 502 can also be in data communication a document processor interface 522, with Bluetooth interface 526 and NFC interface 528 via data path 512.

Processor 502 can also be in data communication with any suitable user input/output (I/O) interface (not shown) which provides data communication with user peripherals, such as displays, keyboards, mice, track balls, touch screens, or the like.

Document processor interface 522 is suitable for data communication with MFP functional units 550. In the illustrate example, these units include a copy engine, suitably comprised of copy hardware 540, a scan engine, suitably comprised of scan hardware 542, a print engine, suitably comprised of print hardware 544 and a fax engine, suitably comprised of fax hardware 546. These subsystems together comprise MFP functional hardware 550. It will be understood that functional units are suitably comprised of intelligent units, including any suitable hardware or software platform.

An enhanced dual staple operation, such as described above, is suitably accomplished by suitable software running on the controller. By way of example, software may be coded in any suitable language to accomplish functionality associated with the pseudocode below:

```
lookup = [
// { pages, delay_ms}
{65, 210},
{30, 200},
{10, 190},
]
start_first_staple( )
start_moving_staple( )
number_pages = get_pages_in_process_tray( )
delay_value = lookup[number_pages]
schedule_second_staple_after(delay_value)
```

In light of the foregoing, it should be appreciated that the present disclosure significantly advances the art of double stapling by finishers. While example embodiments of the disclosure have been disclosed in detail herein, it should be appreciated that the disclosure is not limited thereto or thereby inasmuch as variations on the disclosure herein will be readily appreciated by those of ordinary skill in the art. The scope of the application shall be appreciated from the claims that follow.

What is claimed is:

1. An apparatus, comprising:

a stapler configured to double staple a stack of printed pages of a print job having a number of pages with a first staple in a first staple operation and a second staple in a second staple operation; and a finisher, associated with the stapler, configured to move the stack from a first position to a second position subsequent to the first staple operation, wherein the stapler is further configured to initiate the second staple operation immediately upon expiration of a selected delay, wherein the delay is selected based at least in part on the number of pages in the print job, wherein the print job is stapled with the second staple only after the stack has completed moving to the second position, and wherein the second staple is stapled adjacent to the first staple.

2. The apparatus of claim 1, wherein the stapler is a saddle stapler.

3. The apparatus of claim 1, wherein based on the selected delay, the stack is moving between the first position and the second position when the selected delay expires, such that the second stapling operation is initiated prior to the stack arriving at the second position.

4. The apparatus of claim 1, wherein based on the selected delay, the stack is at the second position when the selected delay expires.

5. The apparatus of claim 1, wherein the delay is selected from a lookup table.

6. The apparatus of claim 5, wherein the lookup table includes a first delay value when the number of pages is less than or equal to a threshold number of pages, and a second delay value when the number of pages is greater than the threshold number of pages, wherein the first delay value is less than the second delay value.

7. The apparatus of claim 6, wherein the lookup table includes a plurality of delay values each associated with a different threshold numbers of pages.

8. A multifunction printer, comprising:

a print engine configured to print a plurality of pages in accordance with a print job that includes a double staple finish selection;

a stapler configured to double staple the print job with a first staple and a second staple;

a finisher configured to reposition the print job after the print job is stapled with the first staple such that the second staple is stapled adjacent to the first staple; and a selectable delay configured to commence stapling the print job with the second staple using a delay time selected from a plurality of delay times based at least in part on the number of pages in the print job, wherein the stapler staples the print job with the second staple only after the finisher has completed repositioning the print job.

9. The multifunction printer of claim 8, wherein the finisher is configured to reposition the print job after the first staple such that the second staple is displaced approximately 125 mm from the first staple.

10. The multifunction printer of claim 9, wherein the selectable delay includes a lookup table.

11. The multifunction printer of claim 10, wherein the lookup table includes a first delay time when the number of pages is less than or equal to a threshold number of pages, and a second delay time when the number of pages is greater than the threshold number of pages, and wherein the first delay time is less than the second delay time.

12. The multifunction printer of claim 11, wherein the lookup table includes three or more delay times each associated with a different threshold numbers of pages.

13. The multifunction printer of claim 11, wherein based on a first delay time selected from the plurality of delay times, the stapler commences stapling a first print job with the second staple prior to the finisher completing the repositioning of the first print job.

14. The multifunction printer of claim 13, wherein based on a second delay time selected from the plurality of delay times, the stapler commences stapling a second print job with a different second staple after the finisher has completed the repositioning of the second print job, wherein the second delay time is greater than the first delay time, and wherein the second print job has a greater number of pages than the first print job.

15. A method, comprising:

stapling, with a first staple and by a stapler of a printer, a print job that includes a number of pages;

determining, by the printer, a delay that is based at least in part on the number of pages in the print job; and commencing, upon expiration of the delay, a second stapling operation of the print job by the stapler with a second staple, wherein the second staple is stapled adjacent to the first staple.

16. The method of claim 15, wherein the stapler is a saddler stapler.

17. The method of claim 15, further comprising:

receiving, by a print engine of the printer, the print job; and printing, by the print engine, the print job.

18. The method of claim 15, further comprising:

moving, prior to stapling the print job with the second staple and by a finisher of the printer, the print job from a first position relative to the stapler associated with the first stapling operation to a second position relative to the stapler associated with the second stapling operation.

19. The method of claim 18, wherein at least a portion of the operation of moving the print job occurs after the initiation of operation to staple the print job with the second staple.

20. The method of claim 18, wherein the operation of stapling with the second staple is initiated after the print job has started moving to the first position, but prior to the print job reaching the second position, and wherein the print job is stapled with the second staple only once the print job is in the second position.

* * * * *